US009289875B2

(12) United States Patent
David et al.

(10) Patent No.: US 9,289,875 B2
(45) Date of Patent: Mar. 22, 2016

(54) FEED FORWARD AND FEED-BACK TECHNIQUES FOR IN-SITU PROCESS CONTROL

(75) Inventors: Jeffrey Drue David, San Jose, CA (US); Jun Qian, Sunnyvale, CA (US); Harry Q. Lee, Los Altos, CA (US)

(73) Assignee: Applied Materials, Inc., Santa Clara, CA (US)

( * ) Notice: Subject to any disclaimer, the term of this patent is extended or adjusted under 35 U.S.C. 154(b) by 870 days.

(21) Appl. No.: 13/456,117

(22) Filed: Apr. 25, 2012

(65) Prior Publication Data

US 2013/0288571 A1 Oct. 31, 2013

(51) Int. Cl.
*B24B 37/00* (2012.01)
*B24B 37/013* (2012.01)
*B24B 49/12* (2006.01)

(52) U.S. Cl.
CPC ..... *B24B 37/013* (2013.01); *B24B 49/12* (2013.01)

(58) Field of Classification Search
CPC ..... B24B 37/013; B24B 49/12; H01L 22/10; H01L 22/12; H01L 22/20
See application file for complete search history.

(56) References Cited

U.S. PATENT DOCUMENTS 6,204,922 B1 * 3/2001 Chalmers ..... 356/630
6,664,557 B1 * 12/2003 Amartur ..... 250/559.27
6,991,514 B1 * 1/2006 Meloni et al. ..... 451/5
7,101,799 B2 * 9/2006 Paik ..... 438/692
7,160,739 B2 * 1/2007 Shanmugasundram et al. ..... 438/14
7,247,080 B1 7/2007 Bennett et al.
7,654,888 B2 2/2010 Zuniga et al.
2007/0042675 A1 * 2/2007 Benvegnu et al. ..... 451/5
2007/0128827 A1 * 6/2007 Faris ..... 438/455
2007/0224915 A1 * 9/2007 David et al. ..... 451/5
2008/0099443 A1 * 5/2008 Benvegnu et al. ..... 216/84
2008/0274670 A1 * 11/2008 Tada et al. ..... 451/6
2010/0056023 A1 * 3/2010 David et al. ..... 451/5
2010/0129939 A1 5/2010 David et al.
2010/0130100 A1 * 5/2010 David et al. ..... 451/5
2010/0217430 A1 8/2010 David et al.
2010/0297916 A1 11/2010 David et al.
2011/0256805 A1 10/2011 David et al.
2011/0281501 A1 * 11/2011 Qian et al. ..... 451/5
2011/0316166 A1 * 12/2011 Yu et al. ..... 257/774

OTHER PUBLICATIONS

International Search Report and Written Opinion in International Application No. PCT/US2013/034839, dated Jul. 10, 2013, 15 pages.
(Continued)

*Primary Examiner* — Lee D Wilson
*Assistant Examiner* — Tyrone V Hall, Jr.
(74) *Attorney, Agent, or Firm* — Fish & Richardson P.C.

(57) ABSTRACT

During polishing of a substrate at a first platen and prior to a first time, a first sequence of values is obtained for a first zone of the first substrate and a second sequence of values is obtained for a different second zone of the substrate with an in-situ monitoring system. A first function is fit to a portion of the first sequence of values obtained prior to the first time, and a second function is fit to a portion of the second sequence of values obtained prior to the second time. At least one polishing parameter is adjusted based on the first fitted function and the second fitted function so as to reduce an expected difference between the zones. A second substrate is polished on the first platen using an adjusted polishing parameter calculated based on the first fitted function and the second fitted function.

20 Claims, 7 Drawing Sheets

(56) References Cited

OTHER PUBLICATIONS

U.S. Appl. No. 13/454,002, filed Apr. 23, 2012, Measurement of Film Thickness Using Fourier Transform, Dominic J. Benvegnu.

U.S. Appl. No. 61/608,284, filed Mar. 8, 2012, Fitting of Optical Model to Measured Spectrum, Jeffrey Drue David et al.

* cited by examiner

FEED FORWARD AND FEED-BACK TECHNIQUES FOR IN-SITU PROCESS CONTROL

TECHNICAL FIELD

This specification relates to the monitoring and control of a chemical mechanical polishing process.

BACKGROUND

An integrated circuit is typically formed on a substrate by the sequential deposition of conductive, semiconductive, or insulative layers on a silicon wafer. A variety of fabrication processes require planarization of a layer on the substrate. For example, for certain applications, e.g., polishing of a metal layer to form vias, plugs, and lines in the trenches of a patterned layer, an overlying layer is planarized until the top surface of a patterned layer is exposed. In other applications, e.g., planarization of a dielectric layer for photolithography, an overlying layer is polished until a desired thickness remains over the underlying layer.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. A polishing liquid, such as abrasive slurry, is typically supplied to the surface of the polishing pad.

One problem in CMP is determining whether the polishing process is complete, i.e., whether a substrate layer has been planarized to a desired flatness or thickness, or when a desired amount of material has been removed. Variations in the slurry distribution, the polishing pad condition, the relative speed between the polishing pad and the substrate, and the load on the substrate can cause variations in the material removal rate. These variations, as well as variations in the initial thickness of the substrate layer, cause variations in the time needed to reach the polishing endpoint. Therefore, determining the polishing endpoint merely as a function of polishing time can lead to within-wafer non-uniformity (WIWNU) and wafer-to-wafer non-uniformity (WTWNU).

In some systems, a substrate is optically monitored in-situ during polishing, e.g., through a window in the polishing pad. However, existing optical monitoring techniques may not satisfy increasing demands of semiconductor device manufacturers.

SUMMARY

Some polishing control processes use information obtained from an in-situ monitoring system to provide feed-back control (an adjustment of the polishing parameters for a subsequent substrate at the same platen) or feed-forward control (an adjustment of the polishing parameters for the same substrate at a subsequent platen). In addition, some polishing control processes use information obtained from an in-situ monitoring system to provide in-situ process control (an adjustment of the polishing parameters for the substrate prior to completion of polishing of the substrate at the platen) to improve polishing uniformity. A combination of in-situ process control with either feed-back control and/or feed-forward control may provide even further improvement of WIWNU and WTWNU. However, how to implement such a combination may not be apparent.

In one aspect, a method of controlling the chemical mechanical polishing of a substrate includes polishing a first substrate on a first platen using a first set of polishing parameters, during polishing of the polishing of the substrate at the first platen and prior to a first time obtaining a first sequence of values for a first zone of the first substrate with an in-situ monitoring system, fitting a first function to a portion of the first sequence of values obtained prior to the first time to generate a first fitted function, during polishing of the polishing of the substrate at the first platen and prior to the first time obtaining a second sequence of values for a different second zone of the substrate with the in-situ monitoring system, fitting a second function to a portion of the second sequence of values obtained prior to the first time to generate a second fitted function, at the first time adjusting at least one polishing parameter of the first set of polishing parameters based on the first fitted function and the second fitted function so as to reduce an expected difference between the first zone and the second zone at an expected endpoint time, calculating an adjusted polishing parameter based on the first fitted function and the second fitted function, and polishing the a second substrate on the first platen using the adjusted polishing parameter.

Implementations can include one or more of the following features. The first function and the second function may be linear functions. After the first time, the first function may be fit to a portion of the first sequence of values at least including values obtained after the first time to generate a third fitted function. When to halt polishing of the first substrate at the first platen may be determined based on the third fitted function. Determining when to halt polishing may include calculating an endpoint time at which the third fitted function equals a target value. Adjusting the at least one polishing parameter may include determining a first slope by calculating a first difference between the target value and a value of the second fitted function at the first time, calculating a second difference between a second time at which the first fitted function equals the target value and the first time, and dividing the first difference by the second difference. Adjusting the at least one polishing parameter may include multiplying the parameter by a ratio of the first slope to a second slope of the second fitted function. Calculating the adjusted polishing parameter may include determining a third slope by calculating a first difference between the target value and a starting value of the second fitted function at a starting time of the polishing operation, calculating a fourth difference between a second time at which the first fitted function equals the target value and the starting time, and dividing the third difference by the fourth difference. Calculating the adjusted polishing parameter may include multiplying an old value for the parameter at the second platen by a ratio of the third slope to a second slope of the second fitted function. The polishing parameter may be a pressure on the substrate. The in-situ monitoring system may be a spectrographic monitoring system.

In another aspect, a method of controlling the chemical mechanical polishing of a substrate includes polishing a first substrate on a first platen using a first set of polishing parameters, during polishing of the polishing of the substrate at the first platen and prior to a first time obtaining a first sequence of values for a first zone of the first substrate with an in-situ monitoring system, fitting a first function to a portion of the first sequence of values obtained prior to the first time to generate a first fitted function, during polishing of the polishing of the substrate at the first platen and prior to the first time, obtaining a second sequence of values for a different second zone of the substrate with the in-situ monitoring system, fitting a second linear function to a portion of the second sequence of values obtained prior to the first time to generate a second fitted function, at the first time adjusting at least one polishing parameter of the first set of polishing parameters based on the first fitted function and the second fitted function so as to reduce an expected difference between the first zone and the second zone at an expected endpoint time, fitting the second linear function to a portion of the second sequence of values obtained after the first time to generate a fourth fitted function, calculating an adjusted polishing parameter based on the first fitted function and the fourth fitted function, and polishing the substrate on a second platen using the adjusted polishing parameter.

Implementations can include one or more of the following features. The first function and the second function may be linear functions. After the first time the first function may be fit to a portion of the first sequence of values at least including values obtained after the first time to generate a third fitted function. When to halt polishing of the first substrate at the first platen may include calculating an endpoint time at which the third fitted function equals a target value. Calculating the adjusted polishing parameter may include determining a third slope by calculating a first difference a first time at which the third fitted function equals the target value a second time at which the fourth fitted function equals the target value. The polishing parameter may be a pressure on the substrate. The in-situ monitoring system may be a spectrographic monitoring system.

In another aspect, a computer program product, tangibly embodied on a computer readable media, may include instructions for causing a processor to control a chemical mechanical polisher to perform operations of any of the methods set forth above.

Advantages of implementations can include one or more of the following. By adjusting polishing pressures on a substrate at the beginning of polishing, the likelihood increases that the substrate will have a flatter profile when it reaches the time that the system adjusts the polishing pressure. Thus, the system will require less pressure adjustment in order to achieve the target profile at the target time. Smaller pressure changes are advantageous because prediction of the result of a smaller pressure change is more reliable, and smaller pressure changes are easier to control. Within-wafer and wafer-to-wafer thickness non-uniformity (WIWNU and WTWNU) can be reduced.

BRIEF DESCRIPTION OF THE DRAWINGS

So that the manner in which the above recited features can be understood in detail, a more particular description, briefly summarized above, may be had by reference to various implementations, some of which are illustrated in the appended drawings. It is to be noted, however, that the appended drawings illustrate only typical implementations and are therefore not to be considered limiting of the scope of the claims, for there may be other equally effective implementations.

Figure 1:
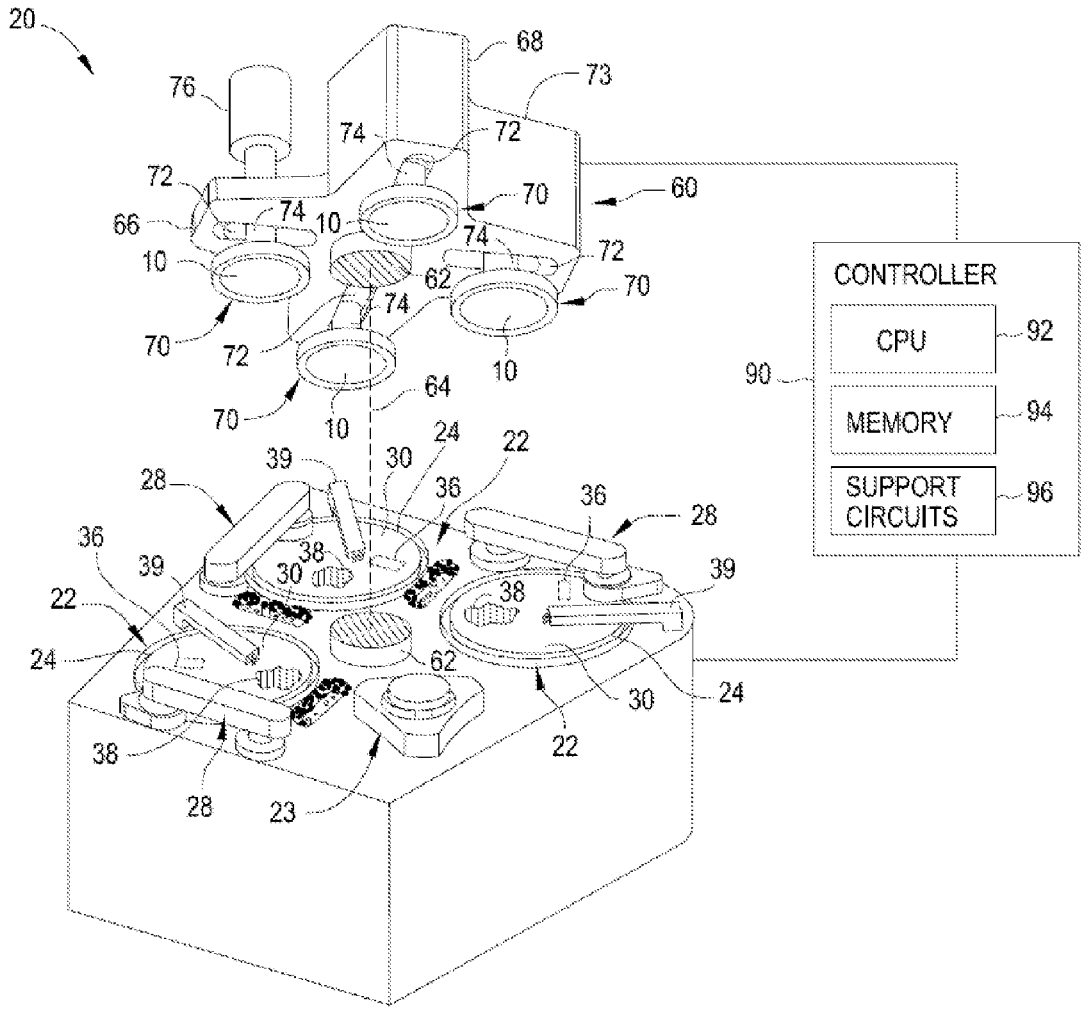
FIG. 1 is a schematic exploded perspective view of a chemical mechanical polishing apparatus.

To facilitate understanding, identical reference numerals have been used, where possible, to designate identical elements that are common to the figures. It is contemplated that elements disclosed in one implementation may be beneficially utilized on other implementations without specific recitation.

DETAILED DESCRIPTION

Implementations described herein relate to monitoring and control of a chemical mechanical polishing process.

Information regarding the relative thickness and endpoint time of various regions of the substrate can be used to adjust polishing parameters, such as the polishing pressure, for each defined region on the substrate so that the different regions reach a target thickness at the same time, to obtain a more uniform polish across the surface of the substrate when polishing is halted simultaneously across the substrate. However, such in-situ modification of polishing parameters may not work well when polish times are short and/or there is not enough time due to poor sampling rates. The implementations described herein use the information regarding the relative thickness and endpoint time to modify polishing parameters for both subsequent substrates polished on the same platen and for the same substrate as the substrate is polished on additional platens.

In some implementations, the relative thickness and endpoint time based on spectra of various regions of a substrate polished on a first platen (platen x) can be used to modify the polishing parameters for the same substrate as the substrate is polished on additional platens (platen x+1). In other implementations, the relative thickness and endpoint time based on spectra of various regions of a first substrate polished on a platen (platen x) can be used to modify the polishing parameters for a second substrate polished on the same platen (platen x). In yet other implementations, the relative thickness and endpoint time based on spectra of various regions of a substrate polished on a first platen (platen x) is used in conjunction with the relative thickness and endpoint time based on the spectra of various regions of the same substrate polished on a second platen (x+1) and used to modify the polishing parameters for subsequent substrates polished on the first platen and/or second platen. Gain factors and other signal processing control techniques may be used to achieve better performance.

While the particular apparatus in which the implementations described herein can be practiced is not limited, it is particularly beneficial to practice the implementations in a REFLEXION LK CMP system and MIRRA MESA® system sold by Applied Materials, Inc., Santa Clara, Calif. Additionally, CMP systems available from other manufacturers may also benefit from implementations described herein. Implementations described herein may also be practiced on overhead circular track polishing systems.

Figure 2:
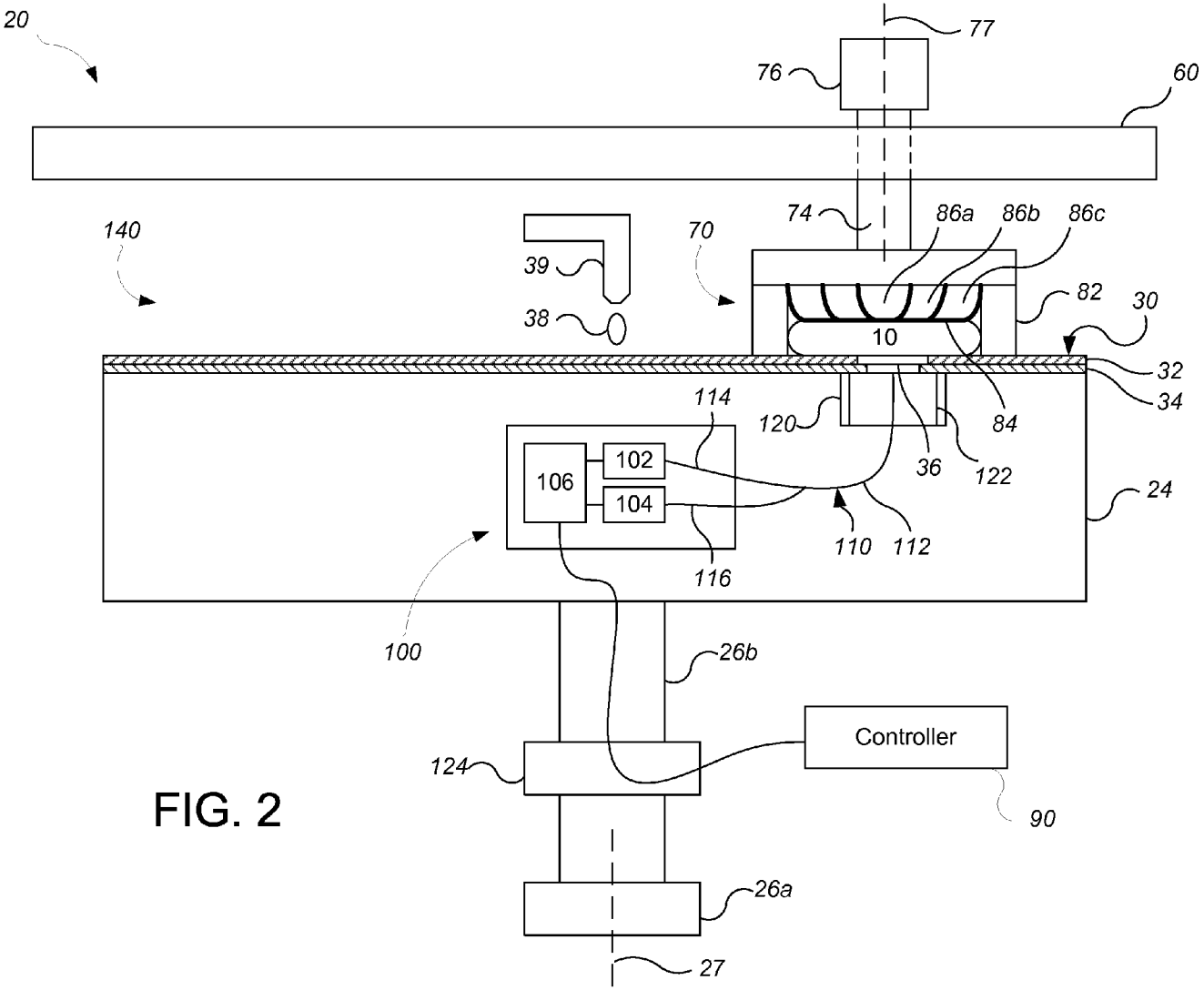
FIG. 2 is a schematic cross-sectional view of a polishing station.

FIGS. 1-2 show an example chemical mechanical polishing apparatus 20 that can polish one or more substrates 10. Polishing apparatus 20 includes a multiple polishing stations 22 and a transfer station 23. Transfer station 23 transfers the substrates between carrier heads 70 and a loading apparatus (not shown).

Each polishing station 22 includes a rotatable platen 24 on which is placed a polishing pad 30. For example, a motor 26*a* can turn a drive shaft 26*b* to rotate the platen 24 about an axis 27.

As an example, the first and second stations 22 can include a two-layer polishing pad 30 a polishing layer 32 and a softer backing layer 34. The final polishing station 22 can include a relatively soft pad, e.g., a buffing pad. Any of the polishing stations 22 can also include a pad conditioner apparatus 28 to maintain the condition of the polishing pad so that it will effectively polish substrates 10.

The polishing apparatus 20 includes at least one carrier head 70. For example, the polishing apparatus 20 can include four carrier heads 70. Each carrier head 70 is operable to hold a substrate 10 against the polishing pad 30. Each carrier head 70 can have independent control of the polishing parameters, for example pressure, associated with each respective substrate.

In particular, the carrier head 70 can include a retaining ring 80 to retain the substrate 10 below a flexible membrane 84. The carrier head 70 also includes a plurality of independently controllable pressurizable chambers defined by the membrane, e.g., three chambers 86*a*-86*c*, which can apply independently controllable pressurizes to associated zones on the flexible membrane 84 and thus on the substrate 10. Although only three chambers are illustrated in FIG. 1 for ease of illustration, there could be one or two chambers, or four or more chambers, e.g., five chambers. A description of a suitable carrier head 70 can be found in U.S. Pat. No. 7,654,888.

The carrier head 70 is suspended from a support structure 60, e.g., a carousel, and is connected by a drive shaft 74 to a carrier head rotation motor 76 (shown by the removal of one quarter of cover 68) so that the carrier head can rotate about an axis 77. Optionally the carrier head 70 can oscillate laterally, e.g., on sliders on the carousel 60, or by rotational oscillation of the carousel itself. In operation, the platen is rotated about its central axis 27, and the carrier head is rotated about its central axis 77 and translated laterally across the top surface of the polishing pad.

Between polishing operations the carrier head 70 can be transported from between the polishing stations 22. In the example shown in FIG. 1, the support structure 60 is a carousel and can be rotated by a central post 62 about a carousel axis 64 by a carousel motor assembly (not shown) to orbit the carrier heads 70 and the substrates 10 attached thereto between polishing stations 22 and transfer station 23. Three of the carrier heads 70 receive and hold substrates 10, and polish them by pressing them against the polishing pads 30. Meanwhile, one of the carrier heads 70 receives a substrate 10 from and delivers a substrate 10 to transfer station 23.

A polishing liquid 38, e.g., an abrasive slurry 38, can be supplied to the surface of the polishing pad 30 by a slurry supply port or a combined slurry/rinse arm 39.

To facilitate control of the polishing apparatus 20 and processes performed thereon, a controller 90 comprising a central processing unit (CPU) 92, memory 94, and support circuits 96, is connected to the polishing apparatus 20. The CPU 92 may be one of any form of computer processor that can be used in an industrial setting for controlling various drives and pressures. The memory 94 is connected to the CPU 92. The memory 94, or computer-readable medium, may be one or more of readily available memory such as random access memory (RAM), read only memory (ROM), floppy disk, hard disk, or any other form of digital storage, local or remote. The support circuits 96 are connected to the CPU 292 for supporting the processor in a conventional manner. These circuits include cache, power supplies, clock circuits, input/output circuitry, subsystems, and the like.

The polishing apparatus also includes an in-situ monitoring system 100. The in-situ monitoring system 100 can be an optical monitoring system, e.g., a spectrographic monitoring system. Although the description below focuses on an optical monitoring system, the control techniques described can be applicable to other types of monitoring systems, e.g., eddy current monitoring systems. The controller 90, or at least software running on the controller 90, can be considered part of the in-situ monitoring system 100.

The optical monitoring system 100 includes an optical access through the polishing pad is provided by including an aperture (i.e., a hole that runs through the pad) or a solid window 36. The solid window 36 can be secured to the polishing pad 30, e.g., as a plug that fills an aperture in the polishing pad, e.g., is molded to or adhesively secured to the polishing pad, although in some implementations the solid window can be supported on the platen 24 and project into an aperture in the polishing pad.

The optical monitoring system 100 can include a light source 102, a light detector 104, and circuitry 106 for sending and receiving signals between the controller 90 and the light source 102 and light detector 104. One or more optical fibers can be used to transmit the light from the light source 102 to the optical access in the polishing pad, and to transmit light reflected from the substrate 10 to the detector 104. For example, a bifurcated optical fiber 110 can be used to transmit the light from the light source 112 to the substrate 10 and back to the detector 104. The bifurcated optical fiber an include a trunk 112 positioned in proximity to the optical access, and two branches 114 and 116 connected to the light source 112 and detector 104, respectively.

In some implementations, the top surface of the platen can include a recess 120 into which is fit an optical head 122 that holds one end of the trunk 112 of the bifurcated fiber. The optical head 122 can include a mechanism to adjust the vertical distance between the top of the trunk 112 and the solid window 36.

The output of the circuitry 106 can be a digital electronic signal that passes through a rotary coupler 124, e.g., a slip ring, in the drive shaft 26*b* to the controller 90 for the optical monitoring system 100. Similarly, the light source 102 can be turned on or off in response to control commands in digital electronic signals that pass from the controller 90 through the rotary coupler 124 to the optical monitoring system 100. Alternatively, the circuitry 106 could communicate with the controller 90 by a wireless signal.

The light source 102 is operable to emit ultraviolet, visible or near infrared light. In some implementations, the light is white light having wavelengths of 200-800 nanometers. A suitable light source for white light is a xenon lamp or a xenon-mercury lamp.

The light detector 104 can be a spectrometer. A spectrometer is basically an optical instrument for measuring properties of light, for example, intensity, over a portion of the electromagnetic spectrum. A suitable spectrometer is a grating spectrometer. Typical output for a spectrometer is the intensity of the light as a function of wavelength.

The in-situ monitoring system 100 generates a time-varying sequence of values that depend on the thickness of a layer on the substrate. For a spectrographic monitoring system, a variety of techniques are available to generate the sequence of values. One monitoring technique is, for each measured spectrum, to identify a matching reference spectrum from a library of reference spectra. Each reference spectrum in the library can have an associated characterizing value, e.g., a thickness value or an index value indicating the time or number of platen rotations at which the reference spectrum is expected to occur. By determining the associated characterizing value for each matching reference spectrum, a time-varying sequence of characterizing values can be generated. This technique is described in U.S. Patent Publication No. 2010-0217430, which is incorporated by reference. Another monitoring technique is track a characteristic of a spectral feature from the measured spectra, e.g., a wavelength or width of a peak or valley in the measured spectra. The wavelength or width values of the feature from the measured spectra provide the time-varying sequence of values. This technique is described in U.S. Patent Publication No. 2011-0256805, which is incorporated by reference. Another monitoring technique is to fit an optical model to each measured spectrum from the sequence of measured spectra. In particular, a parameter of the optical model is optimized to provide the best fit of the model to the measured spectrum. The parameter value generated for each measured spectrum generates a time-varying sequence of parameter values. This technique is described in U.S. Patent Application No. 61/608,284, filed Mar. 8, 2012, which is incorporated by reference. Another monitoring technique is to perform a Fourier transform of each measured spectrum to generate a sequence of transformed spectra. A position of one of the peaks from the transformed spectrum is measured. The position value generated for each measured spectrum generates a time-varying sequence position values. This technique is described in U.S. patent application Ser. No. 13/454,002, filed Apr. 23, 2012, which is incorporated by reference.

Figure 3A:
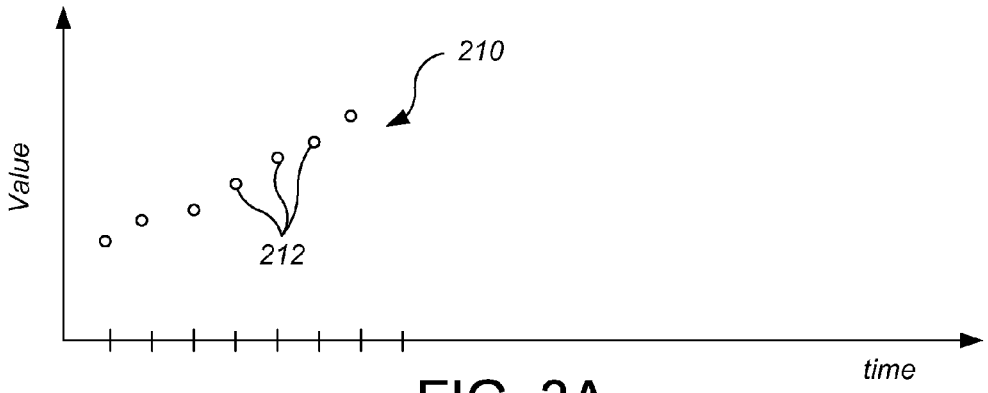
FIG. 3A illustrates a graph of a sequence of values generated by the in-situ monitoring system.

Referring to FIG. 3A, which illustrates an example of a sequence of values 212 generated by the in-situ monitoring system 100. This sequence of values can be termed a trace 210. In general, for a polishing system with a rotating platen, the trace 210 can include one, e.g., exactly one, value per zone per sweep of the sensor of in-situ monitoring system 100 below the substrate 10.

Figure 3B:
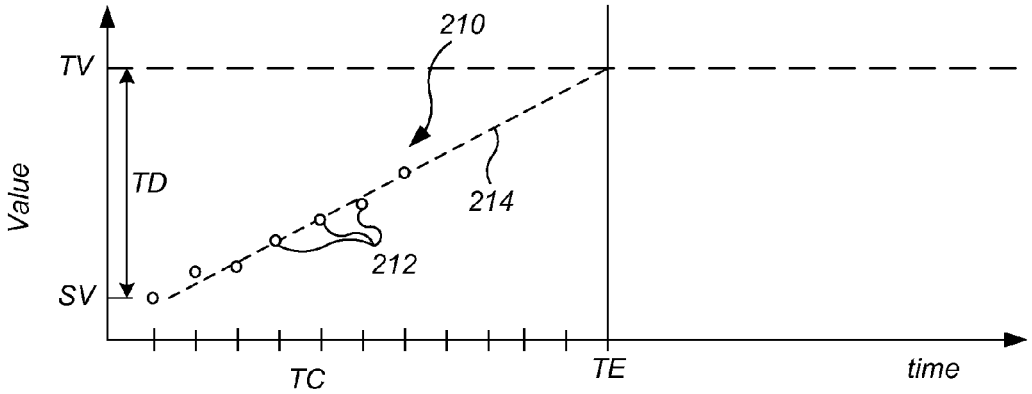
FIG. 3B illustrates a graph of a sequence of values having a function fit to the sequence of values.

As shown in FIG. 3B, a function, e.g., a polynomial function of known order, e.g., a line 214, is fit to the sequence of values, e.g., using robust line fitting. Other functions can be used, e.g., polynomial functions of second-order, but a line provides ease of computation. If the carrier head included only a single controllable chamber, then polishing could be halted at an endpoint time TE that the line 214 crosses a target value TV.

However, in order to improve polishing uniformity, the polishing rates at different potions of the substrate can be compared, and the polishing rates adjusted. As shown in FIG. 4, the in-situ monitoring system makes a series of measurements at points 131-141 as the sensor, e.g., the trunk of the optical fiber and the window, of the in-situ monitoring system traverses the substrate. For example, for an in-situ optical monitoring system, the controller 90 can cause the light source 102 to emit a series of flashes starting just before and ending just after the substrate 10 passes over the sensor (in this case each of points 131-141 depicted represents a location where light from the in-situ monitoring module impinged and reflected off the substrate 10). Alternatively, the controller 90 can cause the light source 102 to emit light continuously, but integrate the signal from the detector 104 to generate values at a sampling frequency.

Over one rotation of the platen 24, measurements are obtained from different radial locations on the substrate 10. That is, some measurements are obtained from locations closer to the center of the substrate 10 and some are closer to the edge. The substrate 10 can be sectioned off into radial zones. In some implementations, the zones may comprise circular and annular zones, for example, the substrate may be divided into an annular edge zone, an annular middle zone, and a circular center zone. Three, four, five, six, seven or more zones can be defined on the surface of the substrate 10. In some implementations described herein, measurements are grouped into their corresponding zones. Where multiple measurements are obtained for a zone, one value can be selected or computed from the measurements. For example, if multiple spectra are measured for a zone, the multiple spectra can be averaged to generate an averaged measured spectrum for the zone.

Thus, the in-situ monitoring system 100 can generate a time-varying sequence of values for each zone on the substrate. For each zone, a polynomial function of known order, e.g., a line, is fit to the sequence of values, e.g., using robust line fitting. The slope and values used in the techniques described below can be obtained from the fitted function. The slope of the fitted function defines the polishing rate (in terms of change of value per time or platen rotation).

Figure 4B:
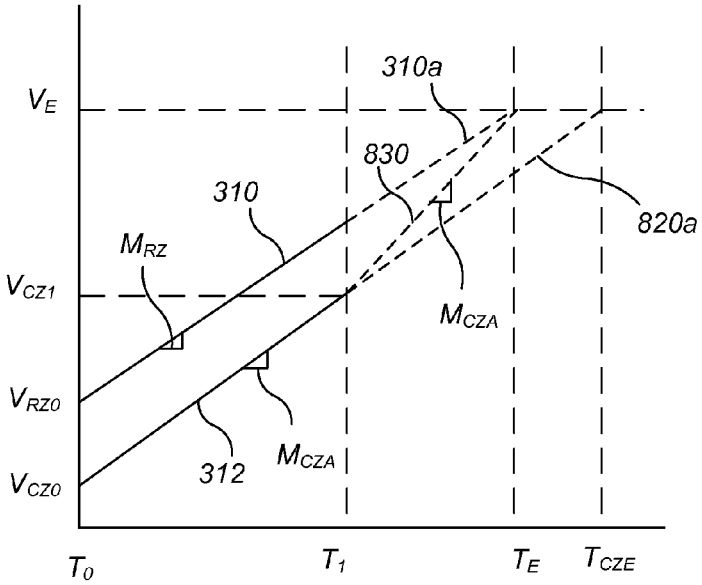
FIG. 4B illustrates a graph of polishing progress for two zones on first substrate in a polishing process in which the polishing rate of one of the zones is adjusted during the polishing operation.
Figure 4A:
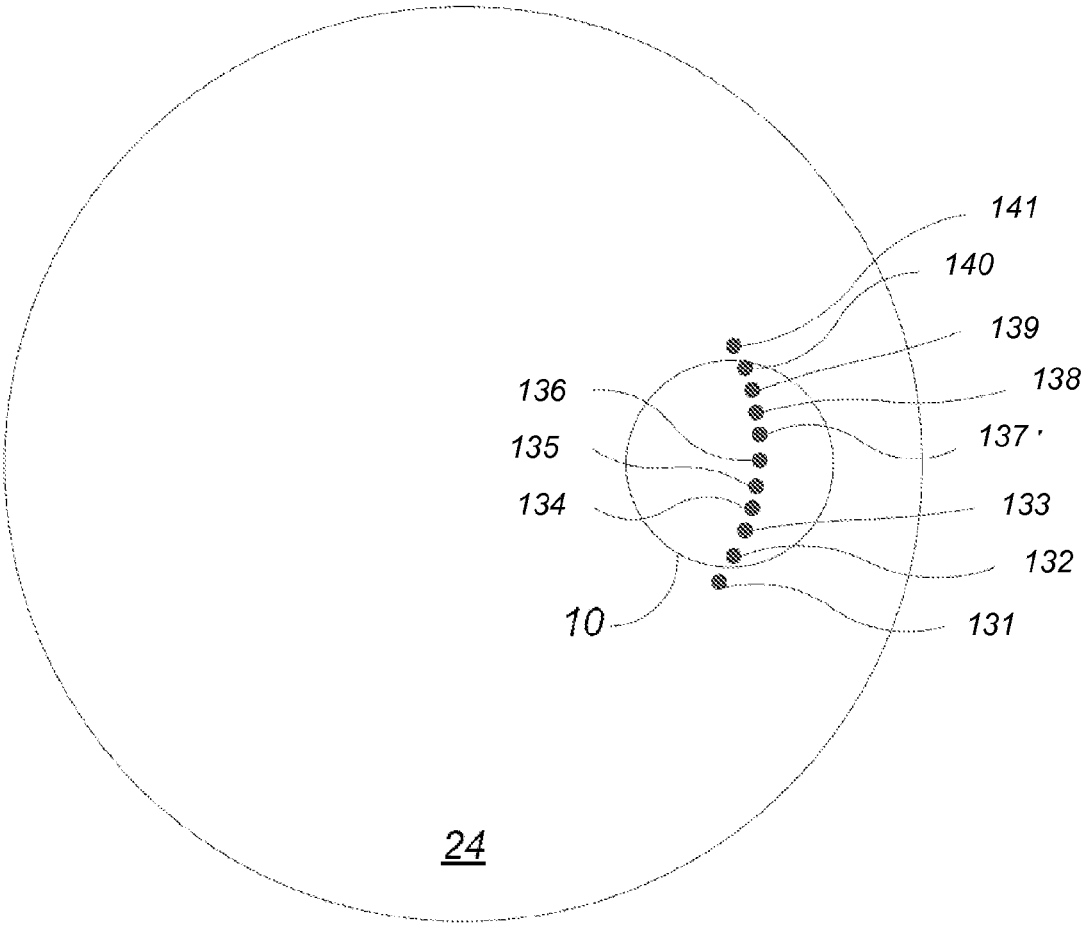
FIG. 4A is an overhead view of a substrate on a platen and shows locations where measurements are taken.

Referring to FIG. 4B, where multiple zones on the substrate are monitoring, at some time during the polishing process, e.g., at a time T1, a polishing parameter for at least one zone is adjusted to adjust the polishing rate of the zone of the substrate such that at a polishing endpoint time, the plurality of zones are closer to their target thickness than without such adjustment. In some embodiments, each zone can have approximately the same thickness at the endpoint time.

In some implementations, one zone is selected as a reference zone, and a projected endpoint time $T_E$ at which the reference zone will reach a target value $V_E$ is determined. The target value $V_E$ can be set by the user prior to the polishing operation and stored. Alternatively, a target amount to remove can be set by the user, and the target value calculated from the target amount to remove. For example, a starting value $V_{RZ0}$ of the reference zone at starting time $T_0$ can be calculated from the function 310 fit to the sequence of values from the reference zone, a difference value can be calculated from the target amount to remove, e.g., from an empirically determined ratio of amount removed to the value (e.g., the polishing rate), and the difference value can be added to the starting value $V_{RZ0}$ to generate the target value $V_E$.

If the function 310 is a line, then the expected endpoint time $T_E$ can be calculated as a simple linear interpolation 310*a* of the line to the target value $V_E$, e.g., $T_E=(V_E-V_{RZ0})/M_{RZ}-T_0$. Polishing can be halted at the time where the fitted function 310 for the reference zone actually intersects target value $V_E$, i.e., the function 310 fitted using the data collected during polishing after the time $T_0$.

One or more zones, e.g., all zones, other than the reference zone (including zones on other substrates) can be defined as control zones. Where the function 312 fit to the sequence of values for a control zone meets the target value $V_E$ define projected endpoint time $T_{CZE}$ for the control zone.

If no adjustments are made to the polishing rate of any of the zones after time $T_1$, then if endpoint is forced at the same time for all zones, then each zone can have a different thickness (which is not desirable because it can lead to defects, degraded chip performance and loss of throughput).

If the target value is expect to be reached at different times for different zones, i.e., $T_{CZE}$ does not equal $T_E$, the polishing rate can be adjusted upwardly or downwardly, such that the zones would reach the target value (and thus target thickness) closer to the same time than without such adjustment, e.g., at approximately the same time. In particular, before time $T_1$ the control zone can be polished at a first pressure $P_{OLD}$, and after time $T_1$ the control zone can be adjusted to a new pressure $P_{NEW}=P_{OLD}*(M_{CZT}/M_{CZA})$ where $M_{CZT}=(T_E-T_1)/(V_E-V_{CZ1})$ where $V_{CZ1}$ is the value of the function 312 for the reference zone at time $T_1$.

In some implementations, an incoming or pre-polish profile determination is made, for example, by measuring the thickness of a particular substrate material across portions of the substrate 10. The profile determination may include determining the thickness profile of a conductive material across the surface of the substrate 10. A metric indicative of thickness may be provided by any device or devices designed to measure film thickness of semiconductor substrates. Exemplary non-contact devices include iSCAN™ and iMAP™ available from Applied Materials, Inc. of Santa Clara, Calif., which scan and map the substrate, respectively. The pre-polish profile determination may be stored in the controller 90.

Figure 5:
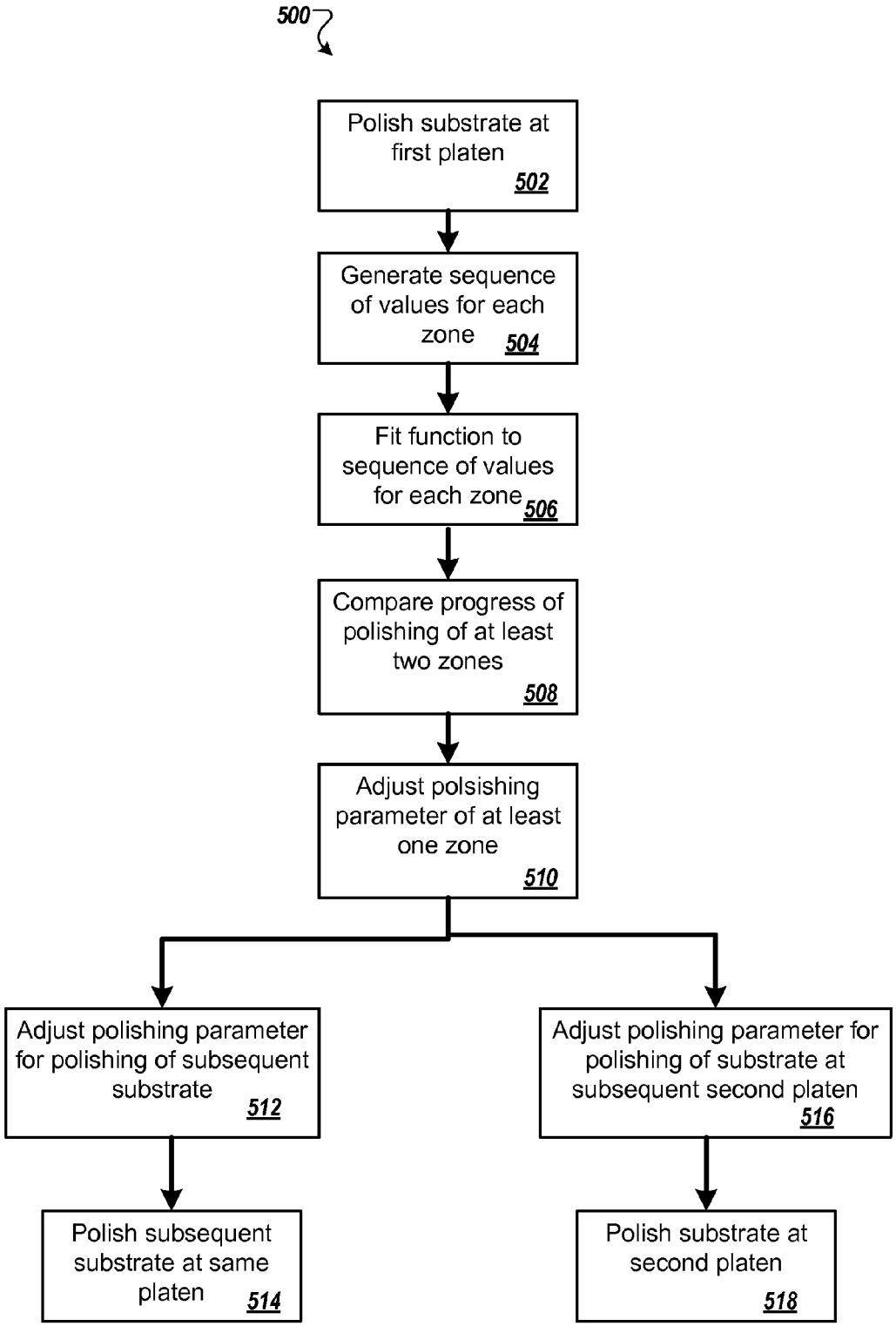
FIG. 5 illustrates a method for polishing a substrate.

FIG. 5 illustrates a general method 500 for polishing a substrate according to implementations described herein. The method begins by polishing a substrate 10 on a first platen 24 using a first set of polishing parameters (step 502). The polishing parameters may include, for example, one or more of the platen rotational speed, the rotational speed of the carrier head, the pressure or downward force applied by the carrier head to the substrate, carrier head sweep frequency, and slurry flow rate.

For each zone, a sequence of values is generated from the in-situ monitoring system during the polishing process (step 504). As noted above, the value could be an actual thickness, an index value, a position of a feature in the spectrum, or a parameter value. For each zone, a function is fit to the sequence of values for that zone (step 506).

The progress of polishing of at least two zones is compared (step 508), and a polishing parameter of at least one of the at least two zones can be adjustment so that at a target endpoint time the thicknesses of the at least two zones are closer than without such modification (step 510). The progress of polishing can be compared using the polishing rate, e.g., the slope of the function, using the present value of the function, using the final value of the function, or some combination thereof. Optionally, the adjustment can be triggered only if a difference in the progress of polishing of the at least two zones exceeds a threshold.

In some implementations, the first zone is a reference zone and the second zone is a control zone. A polishing parameter of the control zone can be modified so that the thickness of the control zone is closer to the thickness of the reference zone at the endpoint time than without such modification. In some implementations an annular middle zone between a circular center control zone and the annular outer control zone can be the reference zone.

In some implementations, a subsequent substrate is polished at the same platen (step 514), but prior to commencing polishing the subsequent substrate, at least one polishing parameter of the first set of polishing parameters for the first zone is adjusted for the subsequent substrate (step 512). This adjustment is based on the progress of polishing of the earlier substrate, thus providing a feed-back control process. Such implementations can improve wafer-to-wafer polishing uniformity.

In some implementations, the substrate is polishing at a second polishing station using a second set of polishing parameters (step 516), but prior to commencing polishing of the substrate at the second polishing station, at least one polishing parameter of the second set of polishing parameters for the first zone is adjusted (step 518). The adjustment is based on the progress of polishing of the substrate at the first platen, thus providing a feed-forward control process. The adjustment can be relative to the default set of second polishing parameters for polishing at the second platen. Such implementations can improve within-wafer polishing uniformity.

Some implementations can use both a feed-forward and a feed-back process.

Examples

The following non-limiting examples are provided to further illustrate implementations described herein. These examples can use the techniques described above. However, the examples are not intended to be all-inclusive and are not intended to limit the scope of the implementations described herein.

In-Situ Process Control and Feed-Back

As noted above in the description of FIG. 4B, using the in-situ monitoring system, it is possible to adjust the polishing rate for a zone of the substrate during the polishing process in order to improve wafer uniformity. At a time $T_1$ during polishing of a first substrate at a first platen, the controller determines if the target profile (usually a flat profile) is being achieved. If the target profile is not being achieved, a pressure in the control zone are adjusted at time $T_1$ to achieve a profile closer to the target, e.g., a flatter profile, by the expected polishing endpoint.

It is possible to use the sequence of values collected before time $T_1$ in a feedback process to adjust the polishing of a subsequent second substrate at the same platen. The time $T_1$ is usually around the middle of the total expected polishing time.

The polishing rate and the slope of the line fit to the sequence of values can drift over the course of the polishing operation. By adjusting the polishing rate on the second substrate based on the sequence of values from the first substrate collected before time $T_1$, it can be more likely that the second substrate will have has flatter profile when it reaches time $T_1$, thus requiring less pressure change at time $T_1$. Smaller pressure changes are desirable as it is easier to control and predict the outcome when making smaller pressure changes.

Figure 6A:
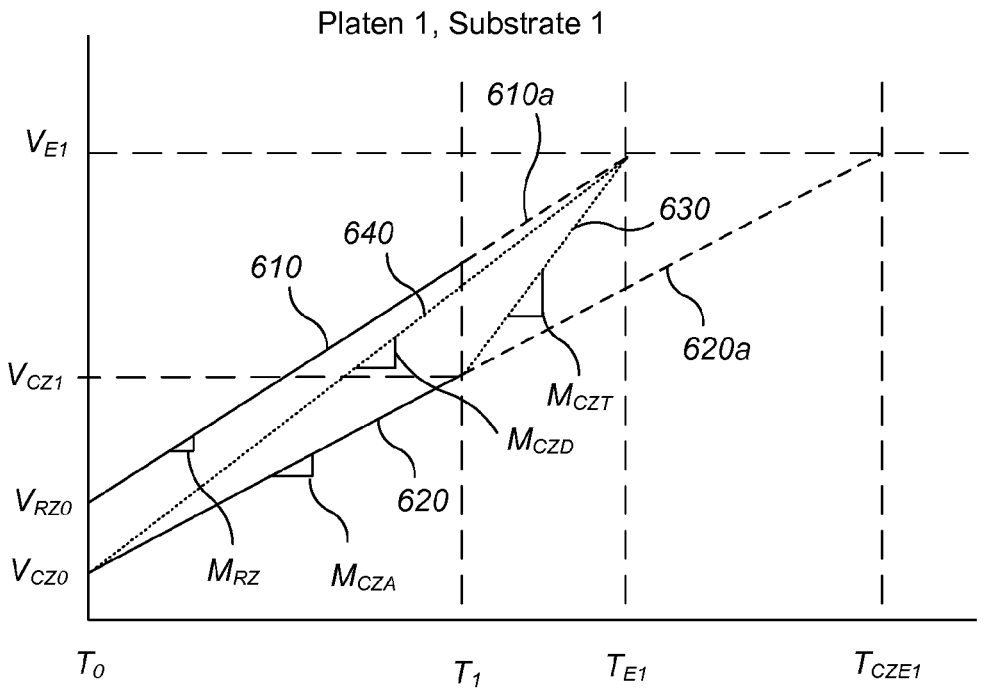
FIGS. 6A-6B illustrate graphs of a polishing progress for a first substrate and a subsequent second substrate, respectively, at a platen, in which a feed-back process is used to adjust the polishing rates of the second substrate at the first platen.
Figure 6B:
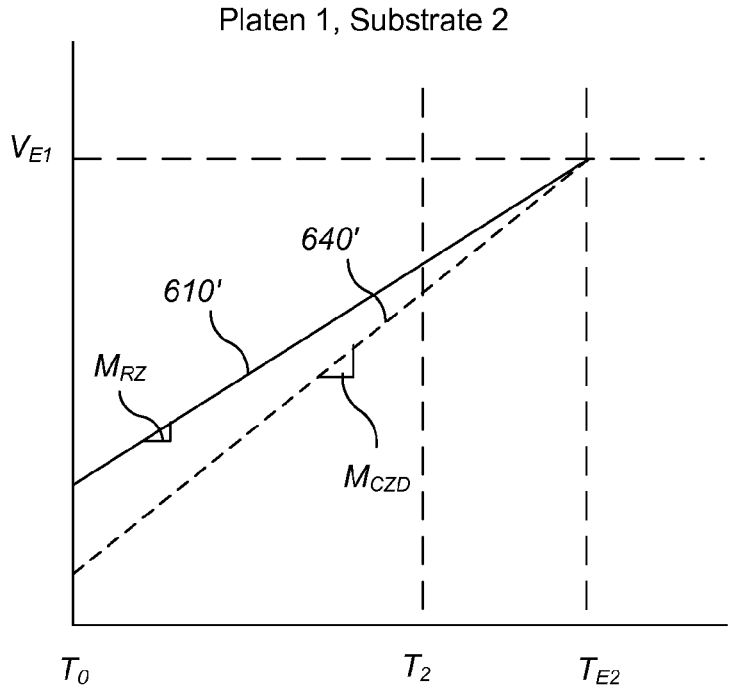

FIG. 6A illustrates a graph of the polishing progress versus time for a first substrate polished on a platen. FIG. 6B illustrates a graph of the polishing progress versus time for a process in which the polishing rates are adjusted for a subsequent second substrate polished on the platen. The polishing rate is indicated by the slope of the function that is fit to the sequence of values for the zone. This is shown schematically be by plotting the value (y-axis) versus time (x-axis). Although the sequences of values can be obtained for three or more zones on the substrate, FIG. 6A shows the functions fit to the sequences of values for a reference zone and a control zone.

Line 610 represents the function that is fit to the sequence of values for the reference zone before time $T_1$. The slope $M_{RZ}$, determined from the slope of line 610, is the polishing rate of the reference zone on the first substrate prior to time $T_1$. $V_{E1}$ represents the target value for the reference zone to halt polishing. $V_{RZ0}$ represents the starting index value for the reference zone and $V_{CZ0}$ represents the starting index value for the control zone, which can be determined from the where the line 610 intersects time $T_0$.

Line 610*a* represents a projection of the function 610 based on values acquired before time $T_1$. $T_{E1}$ represents the time that the reference zone is calculated to reach the target value $V_{E1}$ based on function 610, i.e., the function fitted to values acquired before time $T_1$.

Line 620 represents the function that is fit to the sequence of values for the control zone before time $T_1$. The slope $M_{CZA}$, determined from the slope of line 620, is the polishing rate of the control zone on the first substrate on the first substrate prior to time $T_1$. $V_{CZ0}$ represents the starting value for the control zone, which can be determined from where the line 620 intersects time $T_0$. $V_{CZ1}$ represents the value of at time $T_1$ for the control zone, which can be determined from where the line 620 intersects time $T_1$.

Line 620*a* represents a projection of the function 620 based on values acquired before time $T_1$. $T_{CZE1}$ represents the time that the control zone is calculated to reach the target value $V_{E1}$ based on function 620, i.e., the function 620 fitted to values acquired before time $T_1$.

During polishing of the substrate at the first platen, the polishing rate of the control zone can be adjusted to improve polishing uniformity. The slope $M_{CZT}$, shown as line 630, represents the desired polishing rate of the control zone such that the control zone will converge on the target value ($V_{E1}$) of the reference zone at the time $T_{E1}$. Specifically, the slope $M_{CZT}$ can be calculated as $((V_{E1}-V_{CZ1})/(T_{E1}-T_1)$. Before time $T_1$ the control zone can be polished at a first pressure $P_{OLD}$, and after time $T_1$ the control zone can be adjusted to a new pressure $P_{NEW}=P_{OLD}*(M_{CZT}/M_{CZA})$.

The slope $M_{CZD}$, shown as line 640, represents a desired polishing rate. If the control zone of the first substrate had been polished since time $T_0$ at the desired polishing rate given by slope $M_{CZD}$, the values of the control zone would have converged on the target value ($V_{E1}$) of the reference zone at the time $T_{E1}$. Specifically, the slope $M_{CZT}$ can be calculated as $((V_{E1}-V_{CZ0})/(T_{E1}-T_0)$.

Assuming an identical incoming profile for the subsequent second substrate on the platen, the polishing rate information from the first substrate is fed backward and used to determine an adjusted starting polishing pressure ($P_{ADJUSTED}$) for the control zone of a subsequent substrate at the platen. $P_{ADJUSTED}$ represents the polishing pressure that the control zone of the second substrate should be polished at in order for the control zone to converge on the reference zone. $P_{ADJUSTED}$ can be calculated as $((M_{CZD}/M_{CZA})\times P_{OLD})$. In some implementations, $P_{OLD}$ represents polishing pressure used for polishing the control zone of first substrate on the platen. In some implementations, $P_{OLD}$ represents a default polishing pressure used for polishing the control zone on the first platen.

Polishing of the second substrate commences at time $T_0$ at the adjusted pressure $P_{ADJUSTED}$. As shown by FIG. 6B, as a result, this should result in a polishing rate for the control zone, represented by the slope $M_{CZD}$, shown as line 630', and a polishing rate for the reference zone, represented by the slope $M_{RZ}$, shown as line 610' and that will allowing the control zone and the reference zone to converge at the endpoint time $T_E$, thus providing a more uniform polishing of the second substrate, or at least reducing the amount of adjustment for the control zone at time $T_2$. This approach generally assumes that the polishing rate of the reference zone on second substrate is substantially the same as the polishing rate of the reference zone of the first substrate. This approach also assumes that incoming thickness profile is relatively the same. Gain factors and other control techniques can be applied to dampen or amplify the new recommended pressure ($P_{ADJUSTED}$).

In-Situ Process Control and Feed-Forward to Next Platen

Even after changing a carrier head pressure on a substrate at a platen using the in-situ process control, the desired thickness profile may not be achieved. This can be for a number of reasons, such as noise in the system response and shifting process conditions. To further improve closeness of the actual profile to the desired profile, the value determined at the end of a polishing operation at a first platen (x) can be used to modify the pressure applied to the substrate for a subsequent polishing operation at a second platen (x+1).

As noted above in the description of FIG. 4B, using the in-situ monitoring system, it is possible to adjust the polishing rate for a zone of the substrate during the polishing process in order to improve wafer uniformity. At a time $T_1$ during polishing of a first substrate at a first platen, the controller determines if the target profile (usually a flat profile) is being achieved. If the target profile is not being achieved, a pressure in the control zone are adjusted at time $T_1$ to achieve a profile closer to the target, e.g., a flatter profile, by the expected polishing endpoint.

It is possible to use the sequence of values collected after time $T_1$ in a feedback process to adjust the polishing of the substrate at a subsequent platen. The time $T_1$ is usually around the middle of the total expected polishing time.

The polishing rate (and thus the slope of the line fit to the sequence of values) can drift over the course of the polishing operation. By adjusting the polishing rate on the substrate at the second platen based on the sequence of values from the first substrate collected after time $T_1$, it can be more likely that the substrate will have flatter profile when it reaches time $T_{E2}$, thus requiring less pressure change at time $T_2$. Smaller pressure changes are desirable as it is easier to control and predict the outcome when making smaller pressure changes.

Figure 7A:
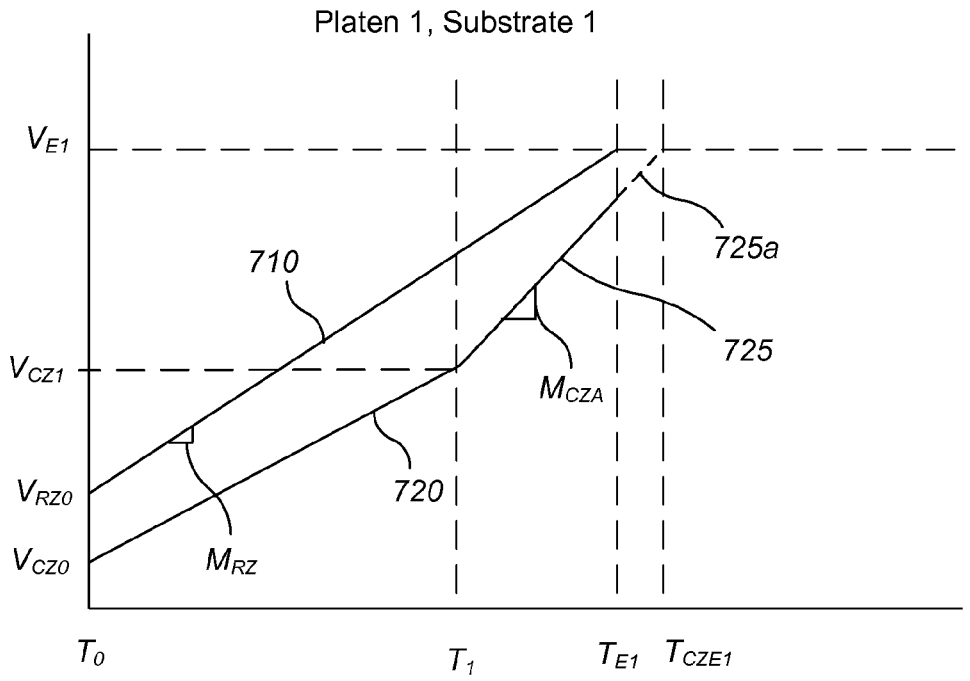
FIGS. 7A-7B illustrate graphs of a polishing progress of substrate at a first platen and a second platen, respectively, in which a feed-forward process is used to adjust the polishing rate of the substrate at the second.
Figure 7B:
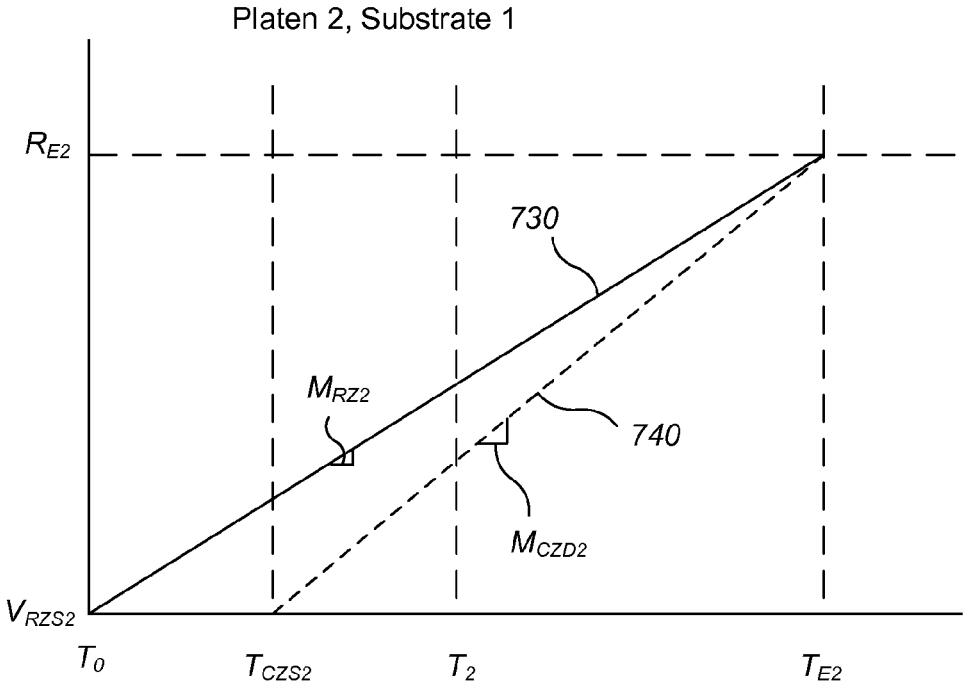

FIG. 7A illustrates a graph of the polishing progress versus time for a substrate polished on a first platen. FIG. 7B illustrates a graph of the polishing progress versus time for a process in which the polishing parameters for the substrate polished on a second platen are adjusted based on the information obtained from polishing the substrate on a first platen. Referring to FIG. 7A, if a particular profile is desired, such as a uniform thickness across the surface of the substrate, the polishing rate, as indicated by the change in values (y-axis) according to time or platen rotations (x-axis), can be monitored and the polishing rate adjusted accordingly. FIG. 7A illustrates the polishing information for a reference zone and a control zone on substrate 1. The polishing rate is indicated by the slope of the function that is fit to the sequence of values. In the graph, this is represented by plotting the index (y-axis) versus time (x-axis).

Line 710 represents the function that is fit to the sequence of values for the reference zone before time $T_{E1}$. The slope $M_{RZ}$, determined from the slope of line 710, is the polishing rate of the reference zone on the first substrate prior to time $T_{E1}$. $V_{E1}$ represents the target value for the reference zone to halt polishing. $V_{RZ0}$ represents the starting index value for the reference zone and $V_{CZ0}$ represents the starting index value for the control zone, which can be determined from the where the line 710 intersects time $T_0$.

Line 720 represents the function that is fit to the sequence of values for the control zone before time $T_1$. $V_{CZ0}$ represents the starting value for the control zone, which can be determined from the where the line 720 intersects time $T_0$. $V_{CZ1}$ represents the value of at time $T_1$ for the control zone, which can be determined from the where the line 720 intersects time $T_1$.

Line 725 represents the function that is fit to the sequence of values for the control zone after time $T_1$, i.e., after the pressure has been adjusted for the control zone. The slope $M_{CZA}$, determined from the slope of line 725, is the polishing rate of the control zone on the first substrate on the first substrate after time $T_1$.

Line 725*a* represents a projection of the function 725 based on values acquired after time $T_1$. $T_{CZE1}$ represents the time that the control zone is calculated to reach the target value $V_{E1}$ based on function 725, i.e., the function 725 fitted to values acquired before time $T_2$.

Although the control zone stops polishing at time $T_{E1}$, the function 725 may be extrapolated to determine where it intersects with the target value $V_{E1}$. The difference between $T_{CZE1}$ and $T_{E1}$ represents the additional polishing time that the control zone would need to achieve the same thickness as the reference zone.

Referring to FIG. 7B, $V_{E2}$ represents the endpoint value for the reference zone of the substrate on the second platen, $T_0$ represents the starting time for polishing of the reference zone of substrate at the second platen, and $T_2$ represents the time that the polishing rate is optionally adjusted.

Line 730 represents a previously determined polishing progress for the reference zone, e.g., the robust line fit for the reference zone from polishing of a prior substrate, e.g., the test substrate using default polishing parameters. $M_{RZ2}$ is the slope of the line 730. $T_{E2}$ represents the time at which the endpoint for the reference zone is expected to be reached on the second platen. $V_{RZS2}$ represents the starting value for the reference zone of the substrate on the second platen. $T_{E2}$ can be calculated from the starting time $T_0$, the starting value $V_{RZS2}$, the endpoint value $V_{E2}$ and the slope $M_{RZ2}$ of the line 730, e.g., $T_{E2}=(V_{E2}-V_{RZS2})/M_{RZ2}-T_0$.

$T_{CZS2}$ represents the effective polishing start time for the control zone of the substrate on the second platen, i.e., the time at which the starting index value $V_{RZS2}$ for the reference zone should be achieved by the control zone.

Line 740 represents the desired polishing progress for the control zone that will enable the control zone and the reference zone to converge on $V_{E2}$ at the same time. $M_{CZD2}$ is the slope of the line 740.

The polishing process on the first platen can be different than the polishing process on the second platen. For example, the polishing process on the first platen can polishes at a faster rate than the polishing process on the second platen. For example, it can take 20 rotations of the first platen to remove 1000 Å of material, while it can take 40 rotations of the second platen to remove 1000 Å of material.

As a result of the differing polishing processes, the difference in thickness between the reference zone and the control zone from the first platen is related to the difference in rotation rates between the first platen and the second platen. $T_{CZS2}$ is calculated as follows: $T_{CZS2}=((RR_2/RR_1)\cdot(T_{CZE1}-T_{E1}))$, where $RR_1$ represents the removal rate at the first platen, $RR_2$ represents the removal rate of the second platen, and $T_{RZ1}$ and $T_{E1}$ were both determined for the first platen. $RR_1$ can be measured as a total number of rotations of the first platen divided by a total polishing time at the first platen, and $RR_2$ can be measured as a total number of rotations of the second platen divided by a total polishing time at the second platen.

$M_{CDZ2}$, the slope of line 740 which represents the desired polishing rate for the control zone to converge on $V_{E2}$, may be calculated as follows: $M_{CZD2}=((V_{E2}/(T_{E2}-T_{CZS2})))$. $P_{NEW}$, the polishing pressure that should be used on the second platen to achieve a uniform polishing profile between the control zone and the reference zone, may be calculated as follows: $((M_{CZD2}/M_{RZ2})*(P_{OLD}))$. In some implementations, $P_{OLD}$ represents polishing pressure used for polishing the reference zone on the second platen. In some implementations, $P_{OLD}$ represents the polishing pressure used for polishing the control zone on the first platen. In some implementations, $P_{OLD}$ represents a default the polishing pressure used for polishing the control zone on the second platen.

The methods and functional operations described in this specification can be implemented in digital electronic circuitry, or in computer software, firmware, or hardware, including the structural means disclosed in this specification and structural equivalents thereof, or in combinations of them. The methods and functional operations can be performed by one or more computer program products, i.e., one or more computer programs tangibly embodied in an information carrier, e.g., in a non-transitory computer readable media, such as a machine readable storage device, or in a propagated signal, for execution by, or to control the operation of, data processing apparatus, e.g., a programmable processor, a computer, or multiple processors or computers. A computer program (also known as a program, software, software application, or code) can be written in any form of programming language, including compiled or interpreted languages, and it can be deployed in any form, including as a stand alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub programs, or portions of code). A computer program can be deployed to be executed on one computer or on multiple computers at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

The substrate can be, for example, a product substrate (e.g., which includes multiple memory or processor dies), a test substrate, and a gating substrate. The substrate can be at various stages of integrated circuit fabrication, e.g., the substrate can include one or more deposited and/or patterned layers. The term substrate can include circular disks and rectangular sheets. The deposited and/or patterned layers can include insulative materials, conductive materials, and combinations thereof. In implementations where the material is an insulative material, the insulative material can be an oxide, e.g., silicon oxide, a nitride, or another insulative material used in the industry to produce electronic devices. In implementations where the material is a conductive material, the conductive material can be a copper containing material, tungsten containing material, or another conductive material used in the industry to produce electronic devices.

While the foregoing is directed to various implementations, other and further implementations may be devised, and the scope of the invention is determined by the claims that follow.

The invention claimed is:

1. A method of controlling chemical mechanical polishing, comprising:

polishing a first substrate on a first platen using a first set of polishing parameters;

during polishing of the first substrate at the first platen and prior to a first time, obtaining a first sequence of values for a first zone of the first substrate with an in-situ monitoring system;

fitting a first function to a portion of the first sequence of values obtained prior to the first time to generate a first fitted function;

during polishing of the first substrate at the first platen and prior to the first time, obtaining a second sequence of values for a different second zone of the first substrate with the in-situ monitoring system;

fitting a second function to a portion of the second sequence of values obtained prior to the first time to generate a second fitted function;

at the first time, adjusting at least one polishing parameter of the first set of polishing parameters based on the first fitted function and the second fitted function so as to reduce an expected difference between the first zone and the second zone at an expected endpoint time;

calculating an adjusted polishing parameter based on the first fitted function and the second fitted function;

polishing a second substrate on the first platen using the adjusted polishing parameter;

after the first time, continuing to obtain the first sequence of values with the in-situ monitoring system and fitting the first function to a portion of the first sequence of values at least including values obtained after the first time to generate a third fitted function; and determining when to halt polishing of the first substrate at the first platen based on the third fitted function.

2. The method of claim 1, wherein the first function and the second function are linear functions.

3. The method of claim 1, wherein determining when to halt polishing comprises calculating an endpoint time at which the third fitted function equals a target value.

4. The method of claim 3, wherein adjusting the at least one polishing parameter includes determining a first slope by calculating a first difference between the target value and a value of the second fitted function at the first time, calculating a second difference between a second time at which the first fitted function equals the target value and the first time, and dividing the first difference by the second difference.

5. The method of claim 4, wherein adjusting the at least one polishing parameter comprises multiplying the parameter by a ratio of the first slope to a second slope of the second fitted function.

6. The method of claim 3, wherein calculating the adjusted polishing parameter includes determining a third slope by calculating a third difference between the target value and a starting value of the second fitted function at a starting time of the polishing operation, calculating a fourth difference between a second time at which the first fitted function equals the target value and the starting time, and dividing the third difference by the fourth difference.

7. The method of claim 6, wherein calculating the adjusted polishing parameter includes multiplying an old value for the parameter at the second platen by a ratio of the third slope to a second slope of the second fitted function.

8. The method of claim 7, wherein adjusting the at least one polishing parameter includes determining a first slope by calculating a first difference between the target value and a value of the second fitted function at the first time, calculating a second difference between a second time at which the first fitted function equals the target value and the first time, and dividing the first difference by the second difference.

9. The method of claim 8, wherein adjusting the at least one polishing parameter comprises multiplying the parameter by a ratio of the first slope to the second slope of the second fitted function.

10. The method of claim 1, wherein the polishing parameter is a pressure applied by a carrier head on a substrate held by the carrier.

11. A computer program product for controlling chemical mechanical polishing, the computer program product tangible embodied in a non-transitory computer readable medium and comprising instructions to cause a processor to:

during polishing of a first substrate at a first platen using a first set of polishing parameters and prior to a first time, receive a first sequence of values for a first zone of the first substrate from an in-situ monitoring system;

fit a first function to a portion of the first sequence of values obtained prior to the first time to generate a first fitted function;

during polishing of the first substrate at the first platen and prior to the first time, receive a second sequence of values for a different second zone of the first substrate from the in-situ monitoring system;

fit a second function to a portion of the second sequence of values obtained prior to the first time to generate a second fitted function;

at the first time, adjust at least one polishing parameter of the first set of polishing parameters based on the first fitted function and the second fitted function so as to reduce an expected difference between the first zone and the second zone at an expected endpoint time;

calculate an adjusted polishing parameter based on the first fitted function and the second fitted function; and cause a second substrate to be polished on the first platen using the adjusted polishing parameter.

12. The computer program product of claim 11, comprising instructions to, after the first time, continue to receive the first sequence of values from the in-situ monitoring system and fit the first function to a portion of the first sequence of values at least including values obtained after the first time to generate a third fitted function.

13. A computer program product for controlling chemical mechanical polishing, the computer program product tangible embodied in a non-transitory computer readable medium and comprising instructions to:

during polishing of a first substrate at a first platen using a first set of polishing parameters and prior to a first time, receive a first sequence of values for a first zone of the first substrate from an in-situ monitoring system;

fit a first function to a portion of the first sequence of values obtained prior to the first time to generate a first fitted function;

during polishing of the first substrate at the first platen and prior to the first time, receive a second sequence of values for a different second zone of the first substrate from the in-situ monitoring system;

fit a second function to a portion of the second sequence of values obtained prior to the first time to generate a second fitted function;

at the first time, adjust at least one polishing parameter of the first set of polishing parameters based on the first fitted function and the second fitted function so as to reduce an expected difference between the first zone and the second zone at an expected endpoint time;

calculate an adjusted polishing parameter based on the first fitted function and the second fitted function;

cause a second substrate to be polished on the first platen using the adjusted polishing parameter;

after the first time, continue to receive the first sequence of values with the in-situ monitoring system and fit the first function to a portion of the first sequence of values at least including values obtained after the first time to generate a third fitted function; and determine when to halt polishing of the first substrate at the first platen based on the third fitted function.

14. The computer program product of claim 13, wherein the instructions to determine when to halt polishing comprise instructions to calculate an endpoint time at which the third fitted function equals a target value.

15. The computer program product of claim 14, wherein the instructions to adjust the at least one polishing parameter include instructions to determine a first slope by calculating a first difference between the target value and a value of the second fitted function at the first time, calculating a second difference between a second time at which the first fitted function equals the target value and the first time, and dividing the first difference by the second difference.

16. The computer program product of claim 15, wherein the instructions to adjust the at least one polishing parameter comprise instructions to multiply the parameter by a ratio of the first slope to a second slope of the second fitted function.

17. The computer program product of claim 14, wherein the instructions to calculate the adjusted polishing parameter comprise instructions to determine a third slope by calculating a third difference between the target value and a starting value of the second fitted function at a starting time of the polishing operation, calculating a fourth difference between a second time at which the first fitted function equals the target value and the starting time, and dividing the third difference by the fourth difference.

18. The computer program product of claim 17, wherein the instructions to calculate the adjusted polishing parameter comprises instructions to multiply an old value for the parameter at the second platen by a ratio of the third slope to a second slope of the second fitted function.

19. The computer program product of claim 18, wherein the instructions to adjust the at least one polishing parameter comprise instructions to determine a first slope by calculating a first difference between the target value and a value of the second fitted function at the first time, calculating a second difference between a second time at which the first fitted function equals the target value and the first time, and dividing the first difference by the second difference.

20. The computer program product of claim 19, wherein the instructions to adjust the at least one polishing parameter comprise instructions to multiply the parameter by a ratio of the first slope to the second slope of the second fitted function.

* * * * *